US010527051B2

(12) United States Patent
Masutani et al.

(10) Patent No.: US 10,527,051 B2
(45) Date of Patent: Jan. 7, 2020

(54) ROTARY MACHINE AND METHOD FOR MANUFACTURING ROTARY MACHINE

(71) Applicant: MITSUBISHI HEAVY INDUSTRIES COMPRESSOR CORPORATION, Tokyo (JP)

(72) Inventors: Jo Masutani, Tokyo (JP); Kazuki Chiba, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 324 days.

(21) Appl. No.: 15/560,078

(22) PCT Filed: Oct. 19, 2015

(86) PCT No.: PCT/JP2015/079417

§ 371 (c)(1),
(2) Date: Sep. 20, 2017

(87) PCT Pub. No.: WO2016/166909

PCT Pub. Date: Oct. 20, 2016

(65) Prior Publication Data

US 2018/0080456 A1 Mar. 22, 2018

(30) Foreign Application Priority Data

Apr. 17, 2015 (JP) ..... 2015-084927

(51) Int. Cl.
*F04D 29/08* (2006.01)
*F04D 29/28* (2006.01)
(Continued)

(52) U.S. Cl.
CPC ..... *F04D 29/083* (2013.01); *F04D 29/284* (2013.01); *F04D 29/4206* (2013.01); *F04D 17/10* (2013.01); *F04D 29/624* (2013.01)

(58) Field of Classification Search
CPC ..... F04D 29/284; F04D 29/286; F04D 29/08; F04D 29/083; F04D 29/162; F04D 29/4206; F04D 29/624; F04D 17/10; F01D 11/122
See application file for complete search history.

(56) References Cited

U.S. PATENT DOCUMENTS 5,411,367 A 5/1995 Walker
5,785,493 A * 7/1998 Ojima ..... F01D 11/122 415/174.1

(Continued)

FOREIGN PATENT DOCUMENTS

JP S56-049273 U 5/1981
JP S63-297772 A 12/1988

(Continued)

OTHER PUBLICATIONS

International Search Report issued in corresponding International Application No. PCT/JP2015/079417 dated Jan. 12, 2016 (4 pages).

(Continued)

*Primary Examiner* — Justin D Seabe
*Assistant Examiner* — Hakeem M Abdellaoui
(74) *Attorney, Agent, or Firm* — Osha Liang LLP

(57) ABSTRACT

A rotary machine includes an impeller. The impeller includes a discoid disk that rotates about an axis line, blades disposed circumferentially at intervals on a surface of the disk facing one side in a direction of the axial line and that form a flow path therebetween that extends radially outward from one side in the direction of the axial line, and a cover that covers the blades from a radially outer side. The rotary machine further includes a casing that covers the impeller from the radially outer side and forms a gap between the casing and an outer surface of the cover; a seal portion provided in the gap; and a lid member.

4 Claims, 10 Drawing Sheets

(51) Int. Cl.

| | |
|---|---|
| ***F04D 29/42*** | (2006.01) |
| ***F04D 17/10*** | (2006.01) |
| ***F04D 29/62*** | (2006.01) |

(56) References Cited

U.S. PATENT DOCUMENTS

| | | | | |
|---|---|---|---|---|
| 5,902,546 | A * | 5/1999 | Kawasetsu | B21K 1/36 420/528 |
| 6,039,535 | A * | 3/2000 | Kobayashi | F04D 29/102 415/172.1 |
| 6,234,749 | B1 * | 5/2001 | Hasegawa | F01D 11/122 415/122.1 |
| 6,488,467 | B2 * | 12/2002 | Czechowski | F04D 25/163 415/122.1 |
| 7,476,081 | B2 * | 1/2009 | Higashimori | F04D 29/30 416/185 |
| 7,628,586 | B2 * | 12/2009 | Feher | B23P 15/006 415/170.1 |
| 9,200,567 | B2 * | 12/2015 | Parker | F01D 21/045 |
| 9,347,460 | B2 * | 5/2016 | Yagi | F04D 29/20 |
| 9,388,821 | B2 * | 7/2016 | Isogai | F01D 25/24 |
| 9,534,503 | B2 * | 1/2017 | Isogai | F01D 5/20 |
| 9,695,838 | B2 * | 7/2017 | Fiedler | F04D 25/024 |
| 9,868,155 | B2 * | 1/2018 | Gerber | B22F 5/009 |
| 9,897,101 | B2 * | 2/2018 | Saito | F04D 29/30 |
| 10,180,143 | B2 * | 1/2019 | Tsuji | F01D 15/10 |
| 10,208,768 | B2 * | 2/2019 | Peer | F04D 29/5853 |
| 2017/0350408 | A1 * | 12/2017 | Sakurai | F02B 39/00 |
| 2018/0030992 | A1 * | 2/2018 | Masutani | F04D 17/125 |
| 2018/0045211 | A1 * | 2/2018 | Okabe | F02B 39/00 |
| 2018/0283394 | A1 * | 10/2018 | Miyoshi | F02C 7/00 |

FOREIGN PATENT DOCUMENTS

| | | | |
|---|---|---|---|
| JP | H04-179897 | A | 6/1992 |
| JP | H04-203565 | A | 7/1992 |
| JP | H05-087090 | A | 4/1993 |
| JP | 2010-133297 | A | 6/2010 |
| JP | 2014-084803 | A | 5/2014 |

OTHER PUBLICATIONS

Written Opinion issued in corresponding International Application No. PCT/JP2015/079417 dated Jan. 12, 2016 (10 pages).

* cited by examiner

LOW MACH NUMBER INFLOW STANDARD TYPE

CROSS SECTION OF FLOW PATH CLOSE TO IMPELLER INLET

CROSS SECTION OF FLOW PATH CLOSE TO IMPELLER OUTLET

LOW MACH NUMBER INFLOW EFFICIENCY IMPROVING TYPE

CROSS SECTION OF FLOW PATH CLOSE TO IMPELLER INLET

CROSS SECTION OF FLOW PATH CLOSE TO IMPELLER OUTLET

SUBSONIC INFLOW STANDARD TYPE

CROSS SECTION OF FLOW PATH CLOSE TO IMPELLER INLET

CROSS SECTION OF FLOW PATH CLOSE TO IMPELLER OUTLET

SUBSONIC INFLOW EFFICIENCY IMPROVING TYPE

CROSS SECTION OF FLOW PATH CLOSE TO IMPELLER INLET

CROSS SECTION OF FLOW PATH CLOSE TO IMPELLER OUTLET

LOW MACH NUMBER INFLOW STANDARD TYPE

LOW MACH NUMBER INFLOW EFFICIENCY IMPROVING TYPE

SUBSONIC INFLOW STANDARD TYPE

CROSS SECTION OF FLOW PATH CLOSE TO IMPELLER INLET

CROSS SECTION OF FLOW PATH CLOSE TO IMPELLER OUTLET

SUBSONIC INFLOW EFFICIENCY IMPROVING TYPE

CROSS SECTION OF FLOW PATH CLOSE TO IMPELLER INLET

CROSS SECTION OF FLOW PATH CLOSE TO IMPELLER OUTLET

ROTARY MACHINE AND METHOD FOR MANUFACTURING ROTARY MACHINE

TECHNICAL FIELD

The present disclosure relates to a rotary machine and a method for manufacturing the rotary machine.

Priority is claimed on Japanese Patent Application No. 2015-084927 filed Apr. 17, 2015, the content of which is incorporated herein by reference.

BACKGROUND ART

Generally, a rotary machine typified by a centrifugal compressor includes an impeller which is provided on a rotating shaft and a casing which defines a flow path between the impeller and the casing by covering the impeller from the outside. The flow path suctions an external fluid into the casing by rotation of the impeller, applies a pressure to the fluid while the fluid flows through the flow path and discharges the fluid from a casing outlet under a high pressure.

As an example of such a technique, a centrifugal compressor disclosed in the following Patent Literature 1 is known. In the centrifugal compressor disclosed in Patent Literature 1, a so-called closed impeller is adopted. That is, this apparatus includes a rotating shaft which rotates about an axis, a disk which is installed at the rotating shaft, a plurality of blades which are disposed on one side surface of the disk, a closed impeller (impeller) which has a shroud cover provided at an end edge on one side of the plurality of blades in an axial direction, and a casing which forms a flow path by covering the closed impeller from the outside. Due to the above-described constitution, a low-pressure fluid introduced from one side in the axial direction is compressed following the rotation of the impeller and guided to the outside from a discharge portion on a radially outer side as a high-pressure fluid.

However, in the rotary machine described above, a predetermined gap is commonly provided between the impeller which is a rotating body and the casing which is in contact with the impeller in a stationary state. That is, interference between the impeller and the casing is prevented by providing the gap therebetween.

CITATION LIST

Patent Literature 1

Japanese Unexamined Patent Application, First Publication No. H4-203565

However, when the gap is formed between the impeller and the casing, the fluid in the flow path may flow into the gap. In particular, when the fluid flows into the gap, the fluid collides with a corner portion R (curved portion) located at an end of the shroud cover, a boundary layer develops on a downstream side thereof, and flow separation or a vortex caused by the flow separation is generated. Once such a disturbance with respect to a flow of the fluid occurs, the disturbance further expands and enlarges due to a deceleration flow inside the impeller, and efficiency of the impeller is reduced. Such a phenomenon may be an obstacle to improving compression efficiency of the compressor.

SUMMARY OF INVENTION

One or more embodiments of the present invention provide a rotary machine having sufficient efficiency and a method for manufacturing the rotary machine.

A rotary machine according to one or more embodiments of the present invention may include an impeller including a discoid disk configured to rotate about an axis line, blades disposed circumferentially at intervals on a surface of the disk facing one side in a direction of the axial line and configured to form a flow path therebetween which extends radially outward from one side in the direction of the axial line, and a cover configured to cover the blades from a radially outer side; a casing configured to cover the impeller from the radially outer side and to form a gap between the casing and an outer surface of the cover; a seal portion provided in the gap; and a lid member provided in a space communicating with the gap between an end surface of the cover on one side in the direction of the axial line and an opposing surface facing the end surface of the casing in the direction of the axial line to protrude from the opposing surface toward the end surface and formed of a material having higher machinability than the cover.

According to one or more embodiments, the space between the end surface of the cover on one side in the direction of the axial line and the opposing surface of the casing is covered from the radially inner side by the lid member. Therefore, the possibility of the fluid flowing into the space can be reduced.

Further, since the lid member is formed of the material having the high machinability, the lid member is cut when the end face of the cover comes in contact with the lid member during an operation of the rotary machine. Therefore, wear and damage due to contact with the lid member is unlikely to occur on the cover.

In the rotary machine according to one or more embodiments, the end surface of the cover may include a cover curved surface which is curved from one side in the direction of the axial line toward the other side along a direction from a radially outer side of the axial line toward a radially inner side thereof, and the cover may further include a cover parallel surface which continues from an end edge of the cover curved surface on a radially inner side toward the other side in the direction of the axial line and extends in parallel with the axial line, and a surface of the lid member on the other side in the direction of the axial line may be a curved opposing surface which is curved from one side in the direction of the axial line toward the other side along a direction from a radially outer side of the axial line toward a radially inner side thereof, and a surface of the lid member on the radially inner side of the axial line may be a parallel inner circumferential surface which extends in parallel with the axial line, and the curved opposing surface and the parallel inner circumferential surface may form a fin portion at the other side in the direction of the axial line, and the fin portion and the cover curved surface of the cover may at least partially overlap each other when seen in a radial direction of the axial line.

According to one or more embodiments, the possibility of the fluid flowing into the inside of the space can be reduced by providing the lid member. Also, since the fin portion of the lid member and at least a part of the cover curved surface overlap each other when seen from the radial direction of the axis line, the possibility of the fluid flowing into the space can be further reduced.

Further, the end face of the cover is curved to form the cover curved surface, and the surface of the lid member on an outer circumferential side thereof is also curved to form the curved opposing surface. Therefore, for example, even when the impeller which is rotating is displaced in the radial direction of the axis line and the cover curved surface and the curved opposing surface are in contact with each other, a relatively wide contact area therebetween can be ensured.

Meanwhile, when the cover and the end face have a corner portion, the contact area can be limited, and thus the damage and the wear of the lid member can be minimized.

In the rotary machine according to one or more embodiments, the parallel inner circumferential surface and the cover parallel surface may have the same position in the radial direction of the axial line when seen in the direction of the axial line.

According to one or more embodiments, the parallel inner circumferential surface and the cover parallel surface extend to the same position in the radial direction of the axial line and thus are formed without a step. Therefore, the possibility of separation, a vortex or the like being formed can be further reduced when the fluid flows from the parallel inner circumferential surface to the cover parallel surface.

In the rotary machine according to one or more embodiments, the fin portion and the end surface of the cover may be in contact with each other.

According to one or more embodiments, by cutting the fin part with the driving of the rotating machine, it is possible to form a minimum gap as long as the impeller can rotate between the fin portion and the end surface.

In one or more embodiments, a method for manufacturing a rotary machine may include an impeller including a discoid disk configured to rotate about an axis line, blades disposed circumferentially at intervals on a surface of the disk facing one side in a direction of the axial line and configured to form a flow path therebetween which extends radially outward from one side in the direction of the axial line, and a cover configured to cover the blades from a radially outer side; a casing configured to cover the impeller from the radially outer side and to form a gap between the casing and an outer surface of the cover and divided into a plurality of parts in the direction of the axial line; and a lid member provided in a space communicating with the gap between an end surface of the cover on one side in the direction of the axial line and an opposing surface facing the end surface of the casing in the direction of the axial line to protrude from the opposing surface toward the end surface and formed of a material having higher machinability than the cover. The method may include a step for preparing the impeller, a step for installing the lid member on the opposing surface, a step for installing the divided casing from both sides in the direction of the axial line in a state in which the lid member and the end surface of the cover are in contact with each other, and a step for rotationally driving the impeller about the axial line and cutting the lid member by contact between the lid member and the end surface of the cover.

According to the above-described method, the casing divided into the plurality of parts in the direction of axial line is installed from both axial sides of the impeller in a state in which the lid member and the end surface of the cover are in contact with each other. Subsequently, by rotationally driving the impeller in this state, the lid member formed of the material having the high machinability is cut by contact with the end surface of the cover. Accordingly, a minimum gap can be formed between the lid member and the end surface of the cover as long as the impeller can rotate. That is, sealing performance of the lid member can be further improved. Further, in assembling, the assembling can be performed with a minute gap between the lid member and the end surface of the cover while the lid member and the end surface of the cover are not in contact with each other.

According to the above-described constitution, it is possible to provide a rotary machine having sufficient efficiency and a method for manufacturing the rotary machine.

DETAILED DESCRIPTION OF EMBODIMENTS

Hereinafter, embodiments will be described with reference to the drawings.

Figure 1:
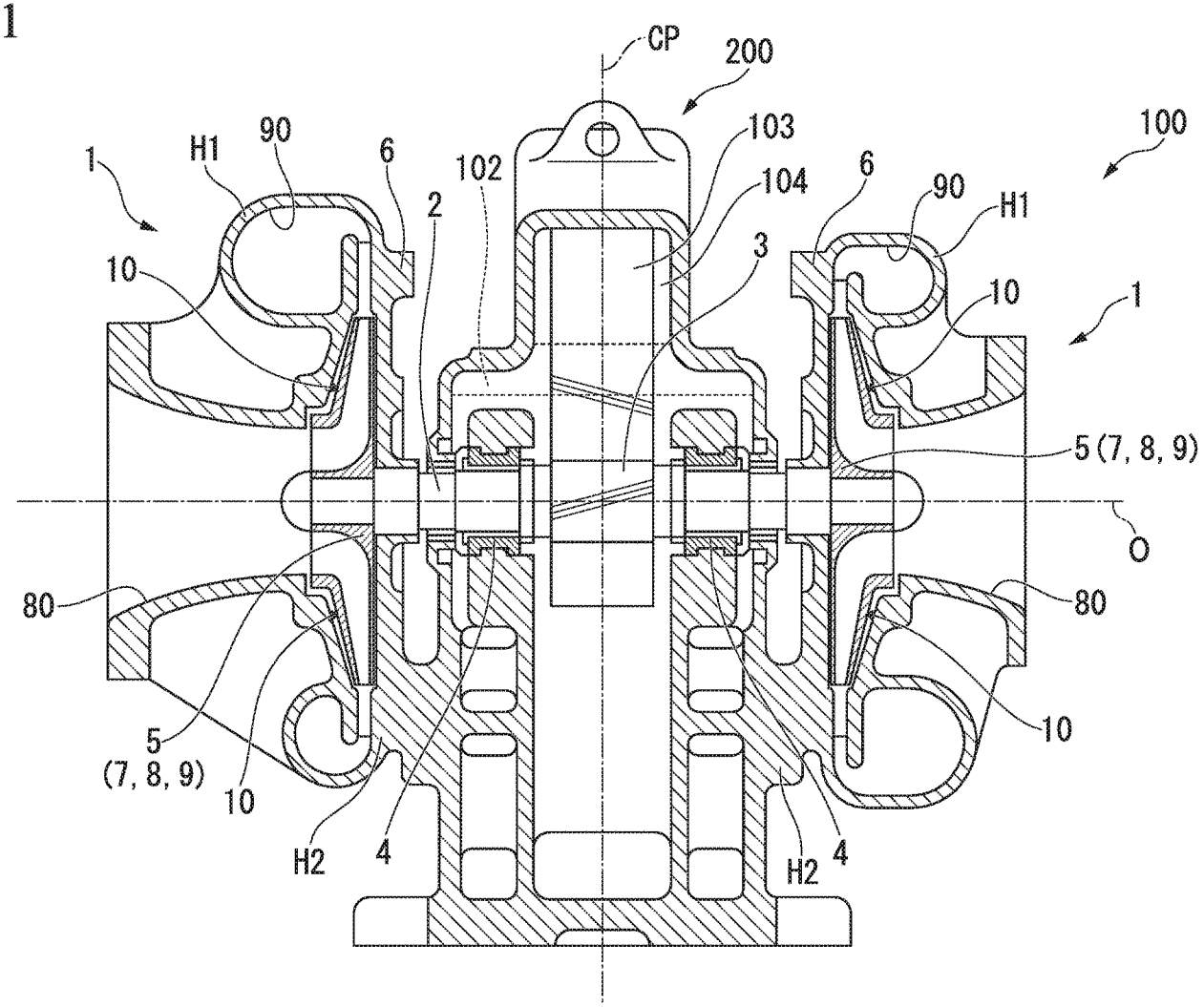
FIG. 1 is a schematic view illustrating a constitution of a geared centrifugal compressor (rotary machine) according to one or more embodiments of the present invention.

According to one or more embodiments, as illustrated in FIG. 1, a geared centrifugal compressor 100 (rotary machine 100) may include an acceleration transmission part 200 which has a rotating drive shaft 102 driven by an external drive source, and a pair of centrifugal compressors 1 which are disposed on both sides of the acceleration transmission part 200. That is, the geared centrifugal compressor 100 is constituted as a single-shaft two-stage compressor. Therefore, a fluid compressed by one (a first-stage centrifugal compressor 1) of the centrifugal compressors 1 subsequently flows into the other centrifugal compressor 1 (a second-stage rallel surface 9E, the pos The fluid is further compressed into a high-pressure fluid while flowing through the second-stage centrifugal compressor 1.

Further, in the following description, the single-shaft two-stage geared centrifugal compressor 100 is described as an example, but a configuration of the geared centrifugal compressor 100 is not limited thereto, and a compressor having more compression stages and more shafts may be applied.

More specifically, a constitution in which the pair of centrifugal compressors 1 are driven by the same rotating shaft 2 while the acceleration transmission part 200 is interposed therebetween is adopted. Further, the pair of centrifugal compressors 1 are constituted to be approximately plane symmetric to each other with respect to a reference plane CP which is an imaginary plane orthogonal to an axial line O of the rotating shaft 2. In other words, one of the centrifugal compressors 1 is mirror-symmetric to the other centrifugal compressor 1.

However, dimensions of each part of the pair of centrifugal compressors 1 may be different from each other.

The acceleration transmission part 200 may include a rotating drive shaft 102 which has a large-diameter gear 103 and is rotated by an external drive source, and an accommodation portion 104 which accommodates a part of the rotating drive shaft 102 and the rotating shaft 2. The large-diameter gear 103 of the rotating drive shaft 102 is a disk-shaped gear which extends in a plane orthogonal to the axial line O of the rotating drive shaft 102.

When a high output and a high torque are desired, a helical gear is appropriately used as such a gear. In the large-diameter gear 103, a tooth pitch or the like is appropriately set to engage with a pinion gear 3 provided on the rotating shaft 2 of the centrifugal compressor 1 which will be described later.

Further, a diameter dimension of the pinion gear 3 is set to be smaller than that of the large-diameter gear 103. Therefore, the number of rotations of the rotating shaft 2 having the pinion gear 3 is larger than that of the rotating drive shaft 102 having the large-diameter gear 103.

A bearing device 4 for rotatably supporting the rotating drive shaft 102 and the rotating shaft 2 is provided inside the accommodation portion 104 forming an outer shell of the acceleration transmission part 200. A device for supplying lubricating oil to the bearing device 4 may be separately provided.

Due to the above-described constitution, a rotational motion of the rotating drive shaft 102 is transmitted to the rotating shaft 2 of the centrifugal compressor 1 via the large-diameter gear 103 and the pinion gear 3. Accordingly, the pair of centrifugal compressors 1 are operated.

Next, a constitution of the centrifugal compressor 1 according to one or more embodiments will be described with reference to FIG. 2. Further, as described above, since the pair of centrifugal compressors 1 in the geared centrifugal compressor 100 of one or more embodiments have the same constitution except that they are plane symmetric to each other, only one centrifugal compressor 1 will be representatively described in the following description.

Figure 2:
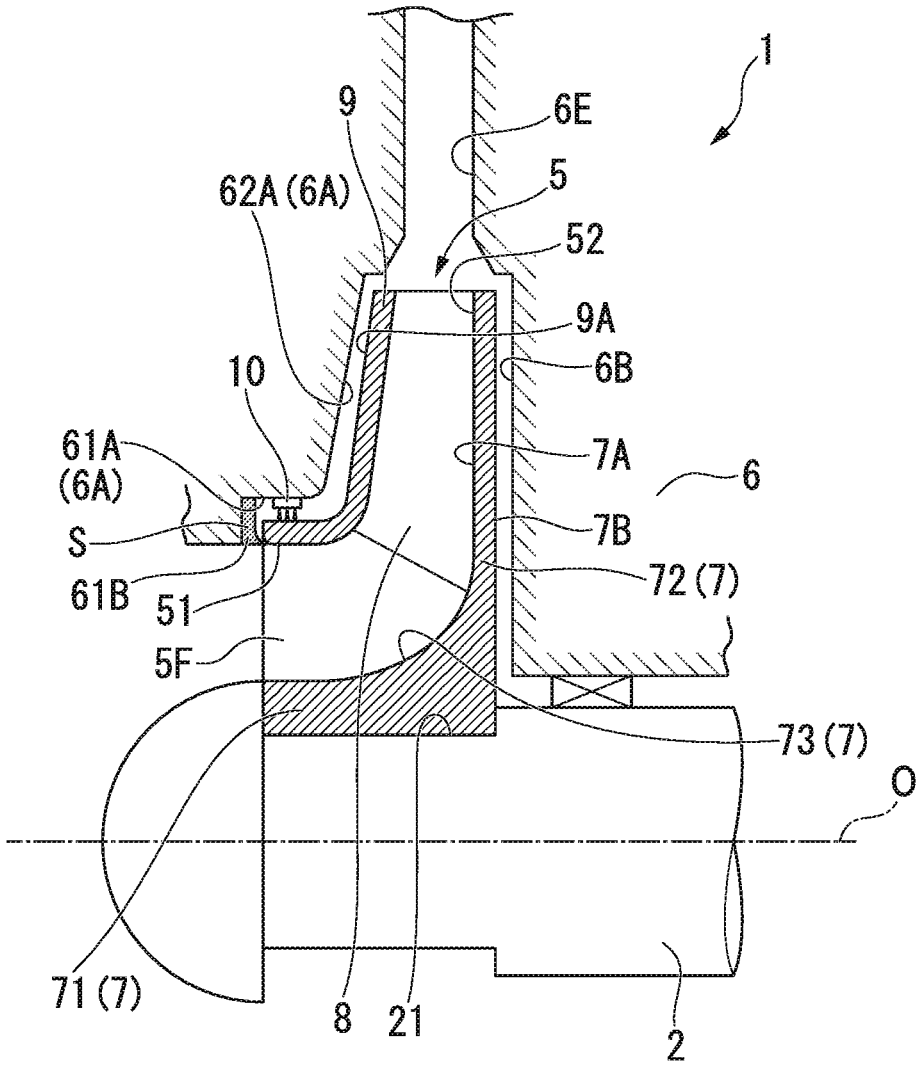
FIG. 2 is an enlarged view of a main part of a rotary machine according to an embodiment of the present invention.

FIG. 2 is an enlarged view of a main part of the centrifugal compressor 1. As illustrated in the drawing, the centrifugal compressor 1 may include the rotating shaft 2 which extends along the axial line O, an impeller 5 which is provided on the rotating shaft 2, and a casing 6 which covers the impeller 5 from the outside.

The rotating shaft 2 is a rotating body which is formed in a cylindrical shape around the axial line O and is rotated around the axial line O by a rotational force applied by the acceleration transmission part 200.

The impeller 5 is an impeller which is provided in the middle of the rotating shaft 2 extending in a direction of the axial line O. More specifically, the impeller 5 may include an approximately discoid disk 7 which protrudes radially outward from an outer circumferential surface of the rotating shaft 2, a plurality of blades 8 which are provided on one side surface of the disk 7 in the direction of the axial line O, and a cover 9 which covers the plurality of blades 8 from one side in the direction of the axial line O.

The disk 7 may include a disk support portion 71 which is fitted in a fitting groove 21 formed on the outer circumferential surface of the rotating shaft 2, and an annular disk main body portion 72 which extends radially outward from the disk support portion 71 in a plate shape.

The disk support portion 71 is formed from one side in the direction of the axial line O toward the other side so that a diameter thereof is gradually increased from a radially inner side toward a radially outer side. The disk main body portion 72 protrudes radially outward from an outer circumferential surface of the disk support portion 71 on the other side in the direction of the axial line O. That is, the disk main body portion 72 is formed externally in an annular plate shape.

Further, a connection portion 73 between the disk support portion 71 and the disk main body portion 72 is formed in a smooth curved surface shape. The one side surface of the above-constituted disk 7 in the direction of the axial line O is a disk surface 7A. Meanwhile, a surface opposite to the disk surface 7A is a disk rear surface 7B formed to be approximately smooth. The disk rear surface 7B extends on a surface approximately orthogonal to the axial line O.

Each of the blades 8 is a thin plate-shaped blade member which extends from the disk surface 7A. Although not specifically illustrated, the blade 8 is curved to one side along a direction from a radially inner side of the disk 7 toward an outer side thereof when seen from the direction of the axial line O.

Further, a height dimension of the blade 8, that is, a protrusion dimension from the disk surface 7A, is gradually reduced from the disk support portion 71 toward the disk main body portion 72. In other words, an end edge of the blade 8 facing one side in the direction of the axial line O, that is, an end edge thereof on an opposite side to the disk 7, is curved to approximately correspond to a curved shape of the disk support portion 71 and the disk main body portion 72.

The plurality of blades 8 as constituted above are disposed radially on the disk surface 7A centering on the axial line O toward a radially outer side. That is, a space is formed between a pair of adjacent blades 8 in a circumferential direction.

Further, the cover 9 is provided on an end edge (an end edge on the opposite side to the disk 7) of each of the plurality of blades 8 over an entire extending dimension of each of the plurality of blades 8. In other words, the plurality of blades 8 are covered from one side in the direction of the axial line O by the cover 9. As described above, since the end edge of the blade 8 is curved to correspond to the shape of the disk surface 7A, the cover 9 is formed externally in approximately a funnel shape.

Further, an end surface 9B of the cover 9 on one side in the direction of the axial line O has a cover vertical surface 9C and a cover curved surface 9D. The cover vertical surface 9C extends radially inward from a radially outer end edge of the end surface 9B in a radial direction of the axial line O. Further, the cover vertical surface 9C does not have to follow the radial direction of the axial line O exactly, and as long as the cover vertical surface is substantially oriented to be in parallel with the radial direction, some distortion due to a machining error or the like is allowed.

Figure 3:
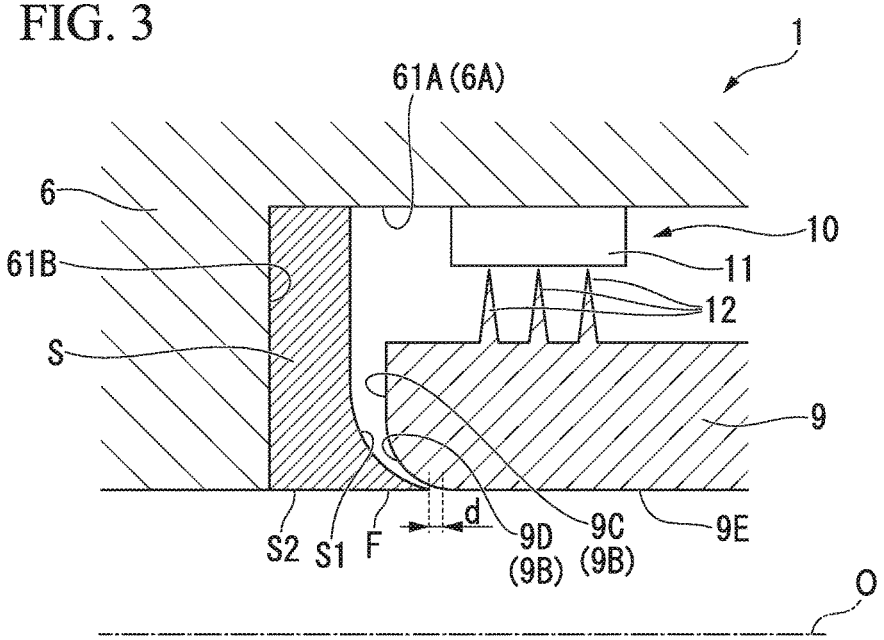
FIG. 3 is an enlarged view of a periphery of an impeller according to an embodiment of the present invention.

As illustrated in FIG. 3, the cover curved surface 9D is curved from one side of the axial line O toward the other side thereof along a direction from a radially outer side of the axial line O toward an inner side thereof. A region from an end edge (i.e., an end edge on the other side of the axial line O) of the cover curved surface 9D on a radially inner side to the other side thereof in the direction of the axial line O is approximately in parallel with the axial line O to be formed as a cover parallel surface 9E. Further, the cover curved surface 9D and the cover parallel surface 9E are continuous to each other and form a uniform surface. In other words, a step or the like is not formed between the cover curved surface 9D and the cover parallel surface 9E.

Further, when seen from the radial direction of the axial line O, a separation dimension between an inner circumferential surface of the cover 9 and the disk surface 7A is gradually reduced from the radially inner side to the radially outer side. Also, possibly, the cover 9 is integrally formed of one member. An outer surface of the cover 9, that is, a surface facing one side in the direction of the axial line O, is an opposing cover surface 9A.

In the impeller 5 configured as described above, an impeller flow path 5F surrounded by the inner circumferential surface of the cover 9 and the disk surface 7A is partitioned and formed. Both sides of the impeller flow path 5F in a circumferential direction thereof are partitioned by the pair of blades 8 which are adjacent to each other. One side of the impeller flow path 5F in the direction of the axial line O is opened toward one side in the direction of the axial line O to be formed as an impeller intake port 51. Meanwhile, an end of the impeller flow path 5F opposite to the impeller intake port 51 is also opened similarly to be formed as an impeller discharge port 52.

The casing 6 forms a part of an outer shell of the centrifugal compressor 1 and covers the impeller 5 from an outside so that an inner circumferential surface thereof faces the impeller 5. Further, in one or more embodiments, the casing 6 is divided into a plurality of parts in the direction of the axial line O. More specifically, as illustrated in FIG. 1, the casing 6 is divided by a dividing plane approximately orthogonal to the axial line O and thus includes a first casing H1 which forms a half on one side in the direction of the axial line O and a second casing H2 which forms a half on the other side.

In addition, an intake flow path 80 (intake pipe 80) which communicates with the outside to introduce air as a working fluid is provided in the casing 6. As illustrated in FIG. 1, the intake pipe 80 is a cone-shaped member of which a diameter is gradually reduced from one side in the direction of the axial line O toward the other side. The air introduced through the intake flow path 80 is guided to the impeller flow path 5F via the above-described impeller intake port 51 inside the casing 6.

Further, a surface of the inner circumferential surface of the casing 6 which faces the opposing cover surface 9A of the impeller 5 with a gap therebetween is an opposing inner circumferential surface 6A. A surface which is located on an opposite side to the opposing inner circumferential surface 6A with the impeller 5 interposed therebetween in the direction of the axial line O is a second opposing inner circumferential surface 6B which faces the disk rear surface 7B with a gap therebetween.

A diffuser 6E which opens outward from a radially outer end is formed in a region surrounded by the opposing inner circumferential surface 6A and the second opposing inner circumferential surface 6B. The diffuser 6E communicates with an exhaust flow path 90 (exhaust flow path 90). As illustrated in FIG. 1, the exhaust flow path 90 is a pipe body which extends in a spiral shape surrounding the above-described intake pipe 80 from an outer circumferential side. High-pressure air is supplied to an external device, which is not illustrated, through the exhaust flow path 90, and is used for various purposes.

Also, the opposing inner circumferential surface 6A may include a cylindrical inner circumferential surface 61A which extends approximately along the axial line O to have a cylindrical shape, and an enlarged diameter inner circumferential surface 62A which is connected to an end of the cylindrical inner circumferential surface 61A on the other side in the direction of the axial line O and also extends radially outward toward the other side.

A diameter of an end of the cylindrical inner circumferential surface 61A on one side in the direction of the axial line O is reduced radially inward, and the end thereof is connected to an inner circumferential surface of the intake flow path. A surface of the reduced diameter portion which faces the other side in the direction of the axial line O is an opposing surface 61B. In one or more embodiments, the opposing surface 61B is formed in an annular shape which widens approximately in the radial direction of the axial line O. Also, the opposing surface 61B does not have to follow the radial direction of the axial line O exactly, and as long as the opposing surface 61B is substantially oriented to be in parallel with the radial direction, some distortion due to the machining error or the like is allowed.

A space formed by the opposing surface 61B and the end surface 9B of the cover 9 communicates with a gap formed by the opposing surface 61B of the cover 9 and the opposing inner circumferential surface 6A described above. A lid member S is provided in the space. The lid member S has an approximately annular shape when seen from the direction of the axial line O and is formed of a material having relatively high machinability. In forming the lid member S, for example, it may be integrally molded with a resin, or it may be molded by kneading aluminum powder with a binder or the like and then compacting the kneaded aluminum powder.

Furthermore, a surface of the lid member S, according to one or more embodiments, which faces the other side in the direction of the axial line O is a curved opposing surface S1. The curved opposing surface S1 is curved from one side of the axial line O to the other side thereof along a direction from a radially outer side toward a radially inner side. Meanwhile, an inner circumferential surface of the lid member S, that is, a radially inner surface thereof, is a parallel inner circumferential surface S2 which extends approximately in parallel with the axial line O. Also, the parallel inner circumferential surface S2 does not necessarily have to be perfectly in parallel with the axial line O, and some distortion due to the machining error or the like is allowed.

The curved opposing surface S1 and the parallel inner circumferential surface S2 which are constituted as described above are connected to each other at an acute angle on the other side in the direction of the axial line O and form a thin plate-shaped fin portion F, as illustrated in FIG. 3. That is, the lid member, S according to one or more embodiments, has the fin portion F and protrudes as a whole from the opposing surface 61B toward the other side in the direction of the axial line O.

The fin portion F faces the cover 9 from one side in the direction of the axial line O. More specifically, the fin portion F faces the end surface 9B of the cover 9 from one side in the direction of the axial line O.

Figure 4:
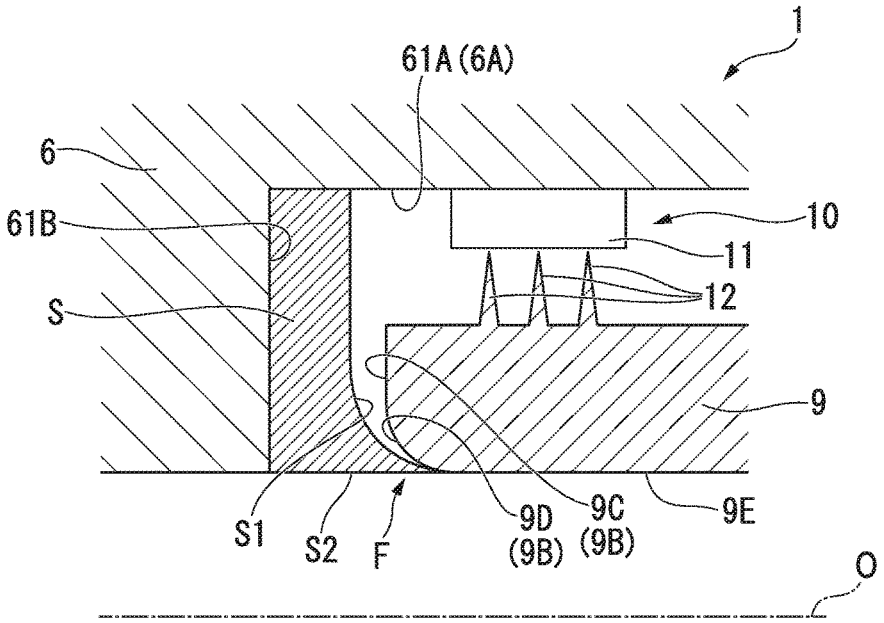
FIG. 4 is an enlarged view of the periphery of the impeller according to an embodiment of the present invention.

More specifically, as illustrated in FIG. 3 or 4, the fin portion F of the lid member S protrudes toward the other side in the direction of the axial line O to follow the cover curved surface 9D. Further, in particular, as illustrated in FIG. 3, a curvature radius of a radially outer surface (that is, a curved outer circumferential surface) of the fin portion F and a curvature radius of the cover curved surface 9D are set to values which are different from each other. In other words, the curved outer circumferential surface and a radially outer region of the end surface 9B of the cover 9 are separated from each other in the direction of the axial line O.

Further, the parallel inner circumferential surface S2 of the lid member S and the cover parallel surface 9E of the cover 9 are formed without a step. More specifically, the parallel inner circumferential surface S2 and the cover parallel surface 9E extend at approximately the same position in the radial direction of the axial line O. Also, in other words, an inner diameter dimension of the cover 9 and an inner diameter dimension of the lid member S are set to be approximately equal to each other.

Further, as will be described in detail later, in a state in which the centrifugal compressor 1 is actually operated, a slight gap (minute gap d) is formed between a distal end (an end on the other side in the direction of the axial line O) of the fin portion F and the cover curved surface 9D of the cover 9, as illustrated in FIG. 3. Meanwhile, in manufacturing the centrifugal compressor 1, in a state immediately after assembling of each member is completed, the distal end of the fin portion F and the cover curved surface 9D are in contact with each other from both sides in the direction of the axial line O, as illustrated in FIG. 4. That is, the minute gap d illustrated in FIG. 3 is naturally forming by rotating the impeller 5 in the state immediately after the assembling illustrated in FIG. 4 and cutting the lid member S having the high machinability through contact with the cover 9.

Furthermore, in one or more embodiments, the above-described second opposing inner circumferential surface 6B of the inner circumferential surface of the casing 6 extends in a planar form approximately in parallel with the outer circumferential surface of the rotating shaft 2. A space is formed radially between the second opposing inner circumferential surface 6B and the outer circumferential surface of the rotating shaft 2. The space communicates with an inside of the accommodation portion 104 of the above-described acceleration transmission part 200.

A seal portion 10 is provided between the casing 6 and the impeller 5 constituted as described above. More specifically, the seal portion 10, according to one or more embodiments, is provided on the cylindrical inner circumferential surface 61A of the opposing inner circumferential surface 6A of the casing 6.

As illustrated in FIG. 3, the seal portion 10 may include an abradable seal portion 11 which extends along the cylindrical inner circumferential surface 61A, and a plurality of seal fins 12 which extend from the cover 9 of the impeller 5 toward the abradable seal portion 11 (that is, from a radially inner side of the axial line O toward an outer side thereof).

The seal fins 12 are formed to be gradually tapered from the radially inner side to the outer side (the distal end), thereby forming a wedge-shaped cross section. Also, in one or more embodiments, the plurality of seal fins 12 are disposed on an outer circumferential surface of the cover 9 at intervals in the direction of the axial line O. However, a type of the seal fins 12 is not limited thereto, and for example, the seal fins 12 may be disposed in close contact with each other without the intervals.

[Manufacturing Method]

Figure 9:
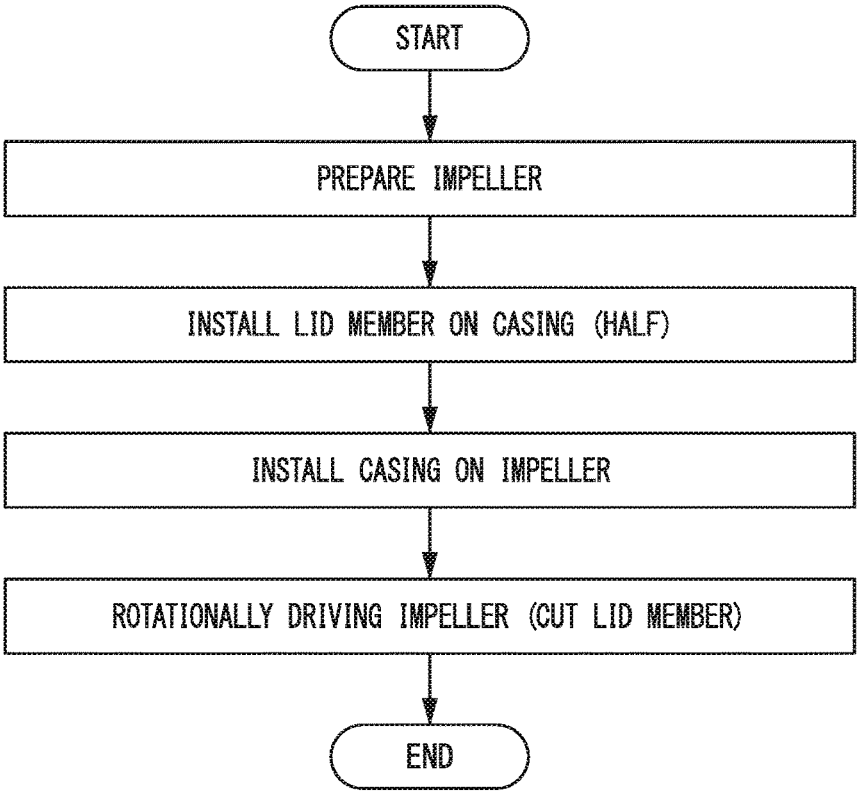
FIG. 9 is a process chart illustrating a method of manufacturing the rotary machine according to an embodiment of the present invention.

Next, a method of manufacturing the centrifugal compressor 1 (rotary machine 100) as the rotary machine 100 according to one or more embodiments will be described with reference to FIG. 9. As illustrated in the drawing, in manufacturing the centrifugal compressor 1, first, the impeller 5 constituted as described above is prepared. In constituting the impeller 5, for example, a process of integral molding using a metal material containing aluminum or iron as a main component is performed.

Subsequently, the casing 6 having the above-described constitution is formed by, for example, casting or the like. As described above, in one or more embodiments, the casing 6 is divided into two parts in the direction of the axial line O in a state in which the centrifugal compressor 1 is assembled. The above-described lid member S is installed on one half in the direction of the axial line O. More specifically, the lid member S which is formed in advance in a separate process is installed on an inner circumferential surface (opposing surface 61B) of the half of the casing 6.

Further, the two halves forming the casing 6 are installed at the impeller 5 while moving in the direction of the axial line O from both sides in the direction of the axial line O. At this time, the lid member S (the distal end of the fin portion F) and the end surface 9B of the cover 9 of the impeller 5 are in a contact state with each other. In this state, the impeller 5 is accommodated inside the casing 6 by fixing the two halves.

Next, in the above-described state, the impeller 5 is rotationally driven around the axial line O by an external power source. Thereby, the lid member S (the distal end of the fin portion F) and the end surface 9 B of the cover 9 which are initially in contact with each other are in sliding contact with each other in the circumferential direction of the axial line O with rotation of the impeller 5. Here, since the lid member S is formed of the material having the high machinability as described above, the lid member S is gradually cut through the continuous sliding contact with the cover 9. By cutting the lid member S, the minute gap d as illustrated in FIG. 3 is naturally formed between the lid member S (particularly, the fin portion F) and the end surface 9B of the cover 9. Accordingly, main processes related to the manufacturing method of the centrifugal compressor 1 are completed.

Operations of the centrifugal compressor 1 and the geared centrifugal compressor 100 which are configured as described above will be described.

First, the rotating drive shaft 102 of the acceleration transmission part 200 is rotationally driven by an external drive source. As such a drive source, for example, an electric motor, a steam turbine or the like is appropriately selected according to a design/specification rating. That is, by connecting an output shaft of the electric motor or the steam turbine to the rotating drive shaft 102, a rotational motion thereof can be transmitted to the rotating drive shaft 102.

When the rotating drive shaft 102 rotates, the large-diameter gear 103 which is provided on the rotating drive shaft 102 also rotates. The large-diameter gear 103 engages with the pinion gear 3 provided on the rotating shaft 2 of the centrifugal compressor 1. Therefore, the rotational motion of the rotating drive shaft 102 is transmitted to the rotating shaft 2 of the centrifugal compressor 1, and the rotating shaft 2 starts to rotate in a direction opposite to a rotational direction of the rotating drive shaft 102.

As the rotating shaft 2 rotates, the pair of centrifugal compressors 1 provided adjacent to the acceleration transmission part 200 are driven. First, the impeller 5 rotates inside the casing 6 with the rotation of the rotating shaft 2. As described above, the impeller intake port 51 for introducing the air as the working fluid is formed on one side of the impeller 5 in the direction of the axial line O. As the number of rotations of the impeller 5 is increased, the air is introduced into the impeller flow path 5F through the impeller intake port 51.

The air introduced into the impeller flow path 5F is given a torque while flowing through the inside of the impeller flow path 5F toward the impeller discharge port 52 by a rotational motion of the impeller 5 and is compressed by the impeller flow path 5F to become the high-pressure air. The high-pressure air flows through the impeller discharge port 52 of the impeller flow path 5F toward the diffuser. The high-pressure air introduced into the diffuser is led to the outside through the above-described exhaust flow path 90 provided in the casing 6 in the same manner. As the operation of the centrifugal compressor 1 is continued, the above-described cycle is continuously repeated.

Figure 10:
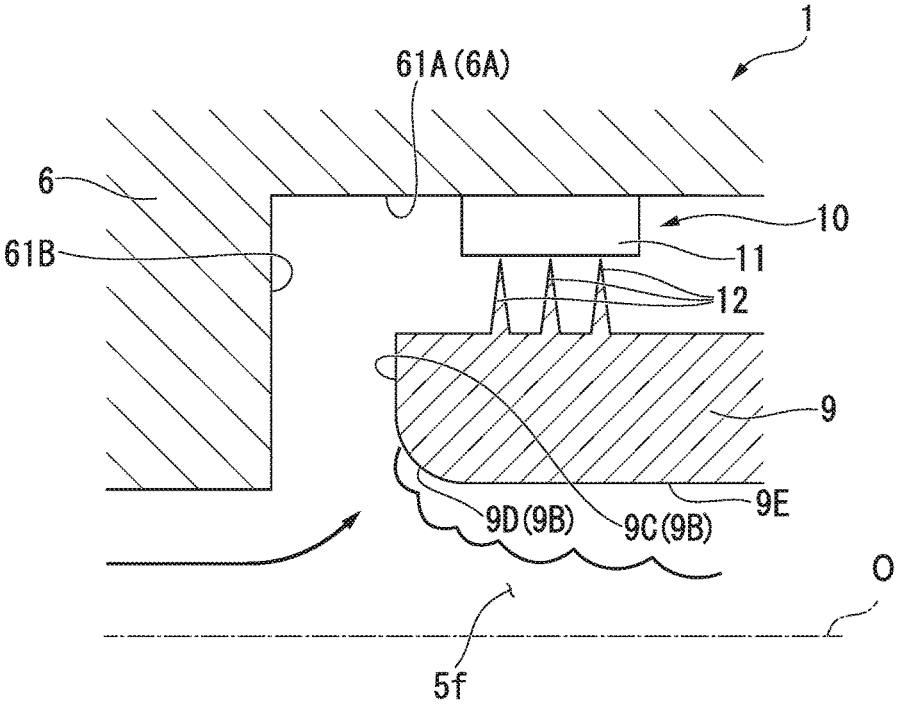
FIG. 10 is an enlarged view of a main part of a conventional impeller.

A fluid flowing into the impeller flow path 5F may flow into or leak from a gap (space) between the end surface 9B of the cover 9 and the opposing surface 61B of the casing 6 during the cycle. When the fluid flows into such a gap, flow separation or development of a boundary layer may occur in the middle of the impeller flow path 5F (refer to FIG. 10). Accordingly, compression efficiency of the centrifugal compressor 1 may be lowered.

However, in the centrifugal compressor 1, according to one or more embodiments as described above, the lid member S is provided in the gap between the end surface 9B of the cover 9 and the opposing surface 61B of the casing 6. The parallel inner circumferential surface S2 of the lid member S covers the gap from a radially inner side, thereby ensuring a sealing property. That is, the possibility of a fluid leak as described above is reduced. As a result, the reduction in the compression efficiency of the centrifugal compressor 1 can be suppressed. In other words, the centrifugal compressor 1 having the sufficiently high compression efficiency can be provided.

In particular, since the lid member S is formed of the material having the high machinability, the lid member S is cut when the end surface 9B of the cover 9 and the lid member S come into contact with each other during the operation of the rotary machine 100. Therefore, wear or damage due to contact with the lid member S is unlikely to occur on the cover 9.

Further, since the fin portion F of the lid member S and at least a part of the cover curved surface 9D overlap when seen from the radial direction of the axial line O, the possibility of the fluid flowing into the above-described space can be further reduced.

In addition, the end surface 9B of the cover 9 is curved and forms the cover curved surface 9D, and the surface of the lid member S on an outer circumferential side is also curved and forms the curved opposing surface S1. Accordingly, for example, even when the impeller 5 which is rotating is displaced in the radial direction of the axial line O and the cover curved surface 9D and the curved opposing surface S1 come into contact with each other, a contact area therebetween can be limited, and thus the wear or the damage of the lid member S can be minimized.

Further, in the centrifugal compressor 1, the parallel inner circumferential surface S2 and the cover parallel surface 9E have the same position in the radial direction of the axial line O when seen from the direction of the axial line O. That is, the parallel inner circumferential surface S2 and the cover parallel surface 9E extend to the same position in the radial direction of the axial line O and thus are formed without a step. Therefore, when the fluid flows from the parallel inner circumferential surface S2 toward the cover parallel surface 9E, the possibility of the separation, the vortex or like occurring can be further reduced.

Further, according to the method of manufacturing the centrifugal compressor 1 as described above, the casing 6 divided into the plurality of parts in the direction of the axial line O is installed from both sides of the impeller 5 in the direction of the axial line O while the lid member S and the end surface 9B of the cover 9 are in contact with each other. Subsequently, as the impeller 5 is rotationally driven in this state, the lid member S formed of the material having the high machinability is naturally cut by the contact with the end surface 9B of the cover 9. Accordingly, the minute gap d having a minimum size can be formed between the lid member S and the end surface 9B of the cover 9 as long as the impeller 5 can rotate. That is, sealing performance of the lid member S can be further improved.

Also, in the assembling, the lid member S and the end surface 9B of the cover 9 can be assembled without the contact with each other in a state in which the minute gap is formed therebetween.

Figure 7A:
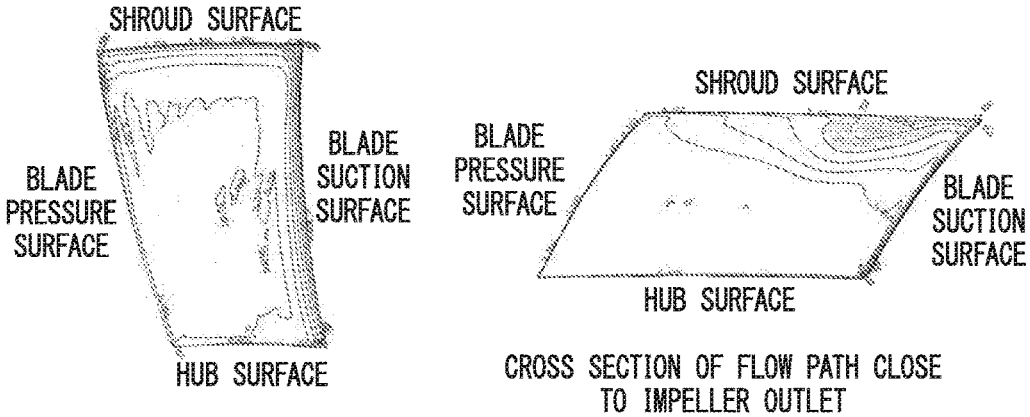
FIG. 7A is a view illustrating an example of a pressure loss distribution on a cross section of an impeller flow path of a centrifugal compressor which is a low Mach number inflow standard type and does not have a lid member.
Figure 7B:
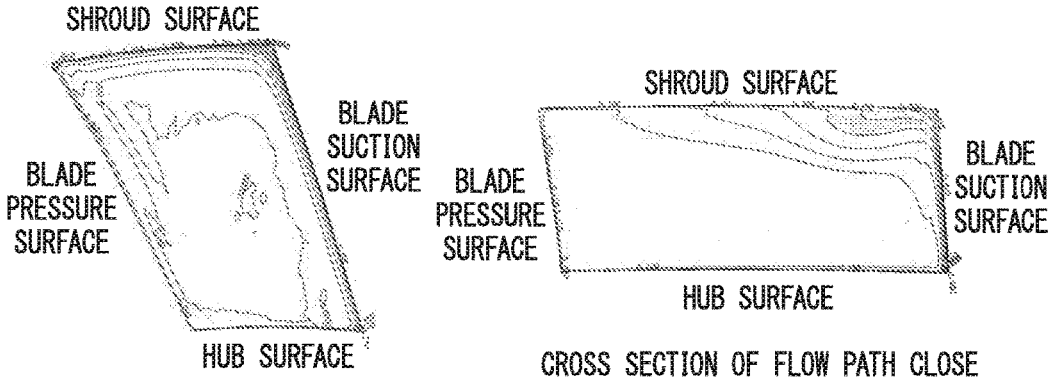
FIG. 7B is a view illustrating an example of a pressure loss distribution on a cross section of an impeller flow path of a centrifugal compressor which is a low Mach number inflow efficiency improving type and does not have a lid member.
Figure 7C:
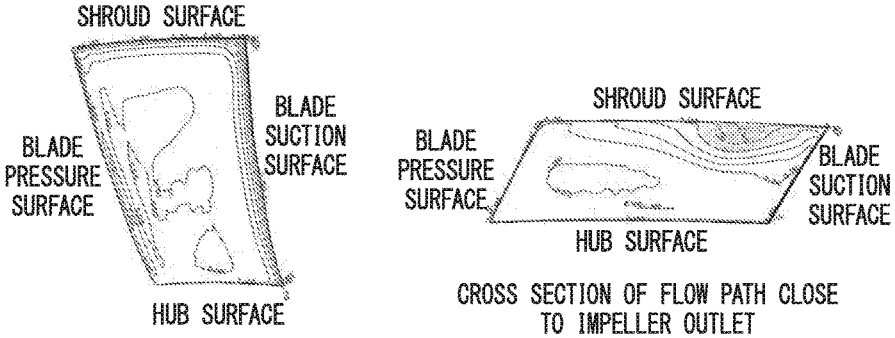
FIG. 7C is a view illustrating an example of a pressure loss distribution on a cross section of an impeller flow path of a centrifugal compressor which is a subsonic inflow standard type and does not have a lid member.
Figure 7D:
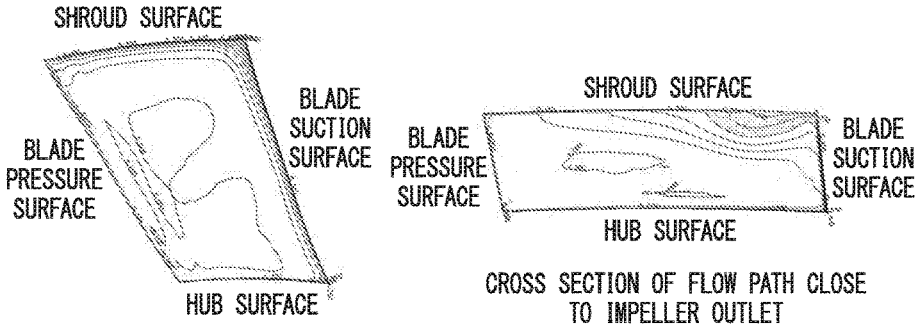
FIG. 7D is a view illustrating an example of a pressure loss distribution on a cross section of an impeller flow path of a centrifugal compressor which is a subsonic inflow efficiency improving type and does not have a lid member.

Here, improvement of the compression efficiency in the centrifugal compressor 1 according to one or more embodiments will be described in more detail with reference to FIGS. 7A to 8C. Each of FIGS. 7A to 7C illustrates a pressure loss distribution diagram on a cross section of an inter-blade flow path (corresponding to the impeller flow path 5F) of the impeller 5 in the centrifugal compressor 1 when a constitution without the above-described lid member S is adopted. Meanwhile, each of FIGS. 8A to 8C illustrates a pressure loss distribution diagram on a cross section of the impeller flow path 5F when the lid member S is provided.

Figure 8A:
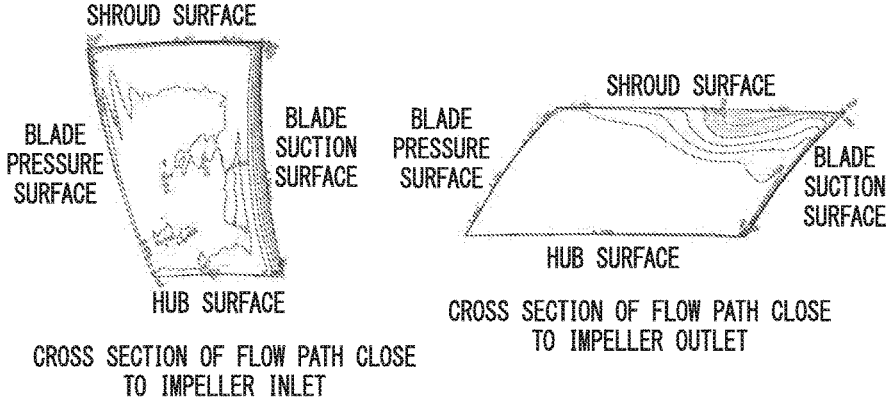
FIG. 8A is a view illustrating an example of the pressure loss distribution on the cross section of the impeller flow path of the centrifugal compressor which is the low Mach number inflow standard type and has the lid member.
Figure 8B:
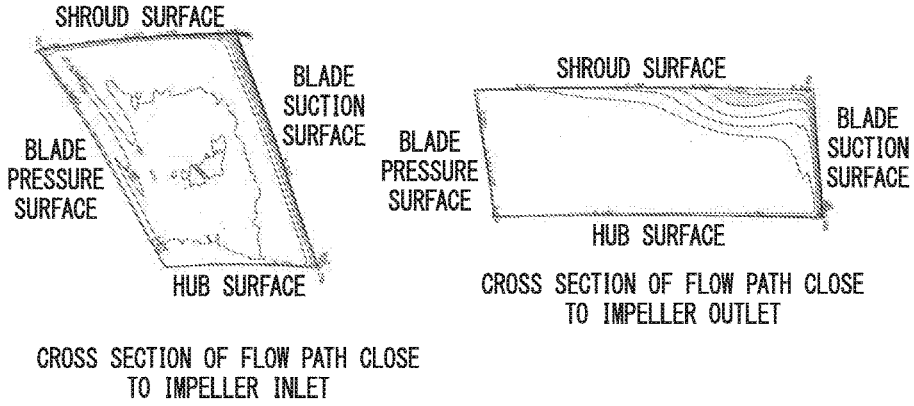
FIG. 8B is a view illustrating an example of the pressure loss distribution on the cross section of the impeller flow path of the centrifugal compressor which is the low Mach number inflow efficiency improving type and has the lid member.
Figure 8C:
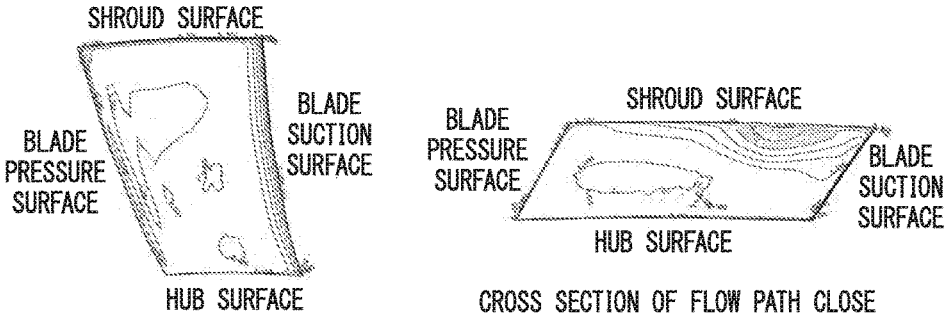
FIG. 8C is a view illustrating an example of the pressure loss distribution on the cross section of the impeller flow path of the centrifugal compressor which is the subsonic inflow standard type and has the lid member.
Figure 8D:
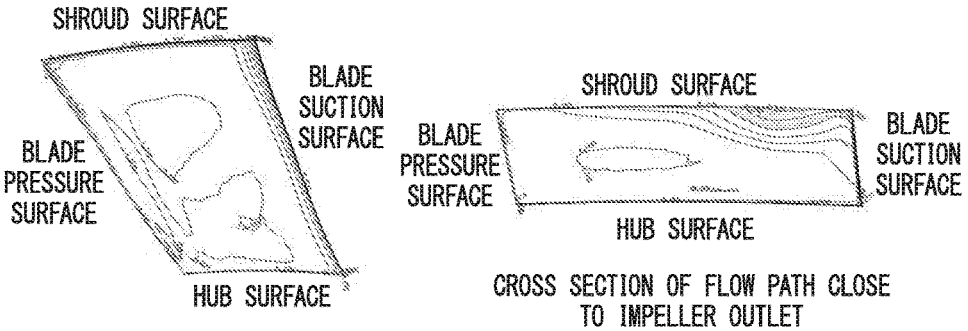
FIG. 8D is a view illustrating an example of the pressure loss distribution on the cross section of the impeller flow path of the centrifugal compressor which is the subsonic inflow efficiency improving type and has the lid member.

Further, each of FIGS. 7A and 8A illustrates a pressure loss distribution diagram in the case of using the impeller 5 to which a fluid having a relatively low Mach number is applied. Each of FIGS. 7B and 8B illustrates a pressure loss distribution diagram in an improved low Mach number impeller (having compression efficiency improved by 1 to 2%). Also, each of FIGS. 7C and 8C illustrates a pressure loss distribution diagram in the case of using the impeller to which a subsonic fluid is applied. Each of FIGS. 7D and 8D illustrates a pressure loss distribution diagram in an improved subsonic type impeller.

Here, in each of the examples of FIGS. 8A to 8D, it can be understood that an area of a pressure loss region is reduced as compared with the examples of FIGS. 7A to 7D. That is, in each of the examples of FIGS. 8A to 8D, a width of the pressure loss region on a shroud surface which is located slightly downstream from an impeller inlet (that is, a dimension of the pressure loss region from a hub surface to the shroud surface in the drawing) becomes smaller. Along with this, the area of the pressure loss region is also reduced on the shroud surface close to an impeller outlet. In particular, since the improved impeller has a smaller pressure loss than the impeller before the improvement, an effect in which the pressure loss at the outlet is reduced is more remarkably obtained in the improved impeller. More specifically, in the improved impeller, an area of a high pressure loss region (a shaded portion in the drawing) is smaller than that in the impeller before improvement. Further, such a pressure loss reduction effect can be obtained equally in any of the low Mach number inflow type and the subsonic inflow type described above. Accordingly, in the centrifugal compressor 1 according to one or more embodiments, it was confirmed that the pressure loss was sufficiently reduced by providing the lid member S.

Embodiments have been described above with reference to the drawings. However, the scope of the present invention is not particularly limited by the dimensions, materials, shapes, or relative positions of the elements described herein, and various modifications may be added.

Figure 5:
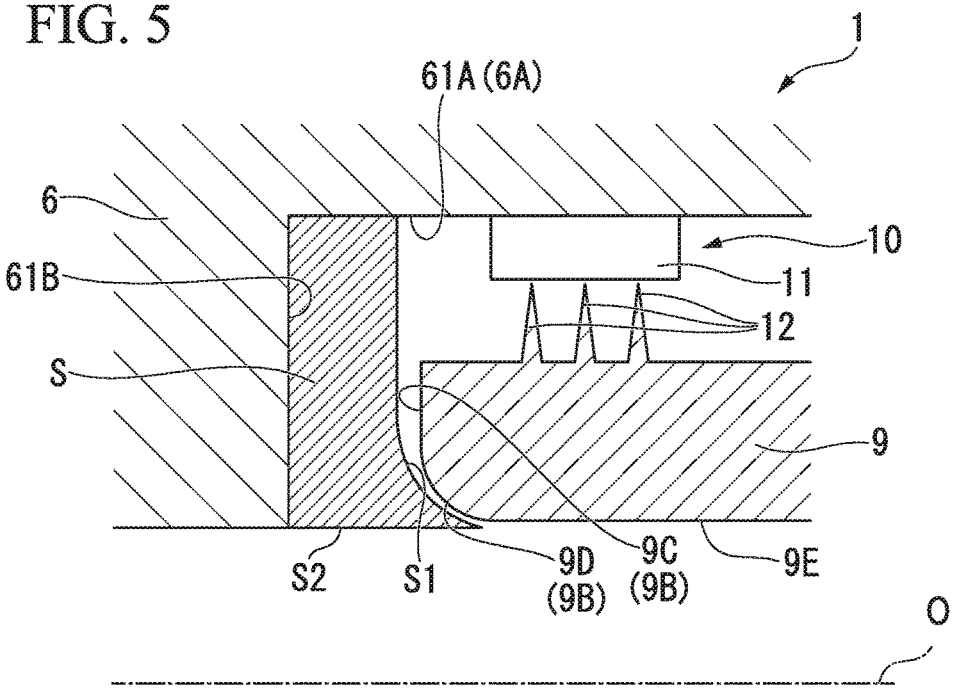
FIG. 5 is an enlarged view of a periphery of an impeller according to an embodiment of the present invention.

For example, in manufacturing each of the above-described members in the centrifugal compressor 1, a manufacturing error for each member may occur, and an assembling error that comes with the assembling may also occur. Due to such errors, for example, as illustrated in FIG. 5, there are cases in which the distal end of the fin portion F is slightly displaced radially inward from the cover parallel surface 9E. Even in such cases, the above-described sealing performance is not hindered by the lid member S. In other words, the example illustrated in FIG. 5 does not depart from the gist of one or more embodiments.

Figure 6:
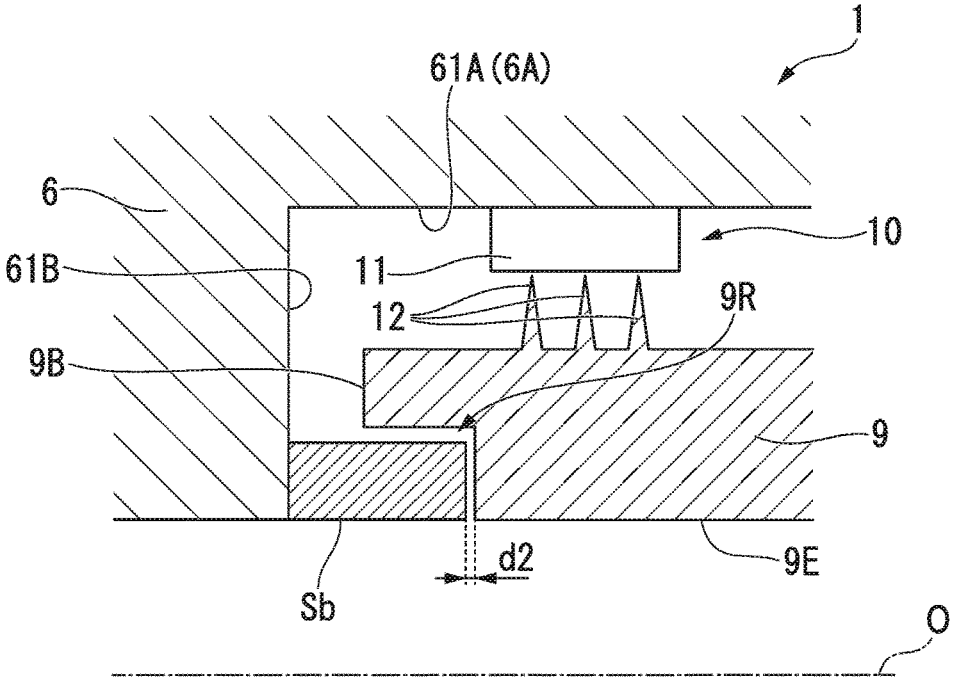
FIG. 6 is an enlarged view of a main part of a rotary machine according to an embodiment of the present invention.

Subsequently, additional embodiments of the present invention will be described with reference to FIG. 6. Further, the same constitutions and members as those in the above-described embodiments are designated by the same reference numerals, and detailed description thereof will be omitted.

As illustrated in the drawing, in one or more embodiments, a lid member Sb is provided only in a partial region of the opposing surface 61B of the casing 6. More specifically, the lid member Sb is formed of a straight tubular cylindrical member having approximately the same diameter dimension from one side in the direction of the axial line O to the other side. Further, the end surface 9B of the lid member Sb on the other side in the direction of the axial line O faces the end surface 9B of the cover 9 which will be described later.

A relief groove 9R which is recessed from one side of the axial line O toward the other side thereof is formed on the end surface 9B of the cover 9 facing the lid member Sb. A radial dimension of the relief groove 9R is set to a value which is approximately equal to a radial dimension of the lid member Sb (that is, a difference between an outer dimension and an inner diameter dimension). The end surface 9B of the relief groove 9R in the direction of the axial line O forms a minute gap d2 with the lid member Sb, as described above. Further, by foxy ling such a relief groove 9R, a part of an outer circumferential surface of the lid member Sb and an inner circumferential surface (radially inner surface) of the relief groove 9R face each other in the radial direction of the axial line O.

The same sealing performance and good compression efficiency as those in previously described embodiments can be obtained with the above-described constitution. Further, since the lid member Sb, in one or more embodiments, has a simple straight tubular shape, it can be easily mass-produced. Accordingly, manufacturing cost can be reduced.

Further, as described above, the lid member Sb and the end surface 9B of the cover 9 overlap each other via the relief groove 9R. Therefore, even when the fluid leaks radially outward via the minute gap d2, additional leakage and infiltration of the fluid can be suppressed by the inner circumferential surface of the relief groove 9R.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

INDUSTRIAL APPLICABILITY

According to one or more embodiments described above, it is possible to provide a rotary machine having sufficient efficiency and a manufacturing method of the rotary machine.

REFERENCE SIGNS LIST

1 Centrifugal compressor
2 Rotating shaft
3 Pinion gear
4 Bearing device
5 Impeller
6 Casing
7 Disk
8 Blade
9 Cover
10 Seal portion
11 Abradable seal portion
12 Seal fin
21 Fitting groove
51 Impeller intake port
52 Impeller discharge port
70 Abradable portion
71 Disk support portion
72 Disk main body portion
73 Connection portion
80 Intake flow path
80 Intake pipe
90 Exhaust flow path
90 Exhaust pipe
100 Rotary machine (geared centrifugal compressor)
101 Rear seal portion
102 Rotating drive shaft
103 Large-diameter gear
104 Accommodation portion
200 Acceleration transmission part
5F Impeller flow path
61A Cylindrical inner circumferential surface
61B Opposing surface
62A Enlarged diameter inner circumferential surface
6A Opposing inner circumferential surface
6B Second opposing inner circumferential surface
6E Casing discharge port
7A Disk surface
7B Disk rear surface
9A Opposing cover surface
9B End surface
9C Cover vertical surface
9D Cover curved surface 9E Cover parallel surface
9R Relief groove
CP Reference plane
d Minute gap
d2 Minute gap
F Fin portion
H1 First casing
H2 Second casing
O Axial line
S Lid member
S1 Curved opposing surface
S2 Parallel inner circumferential surface
Sb Lid member

The invention claimed is:

1. A rotary machine comprising:

an impeller including:

a discoid disk that rotates about an axis line, blades disposed circumferentially at intervals on a surface of the disk facing one side in a direction of the axial line and that form a flow path therebetween that extends radially outward from one side in the direction of the axial line, and a cover that covers the blades from a radially outer side;

a casing that covers the impeller from the radially outer side and forms a gap between the casing and an outer surface of the cover;

a seal portion provided in the gap; and a lid member provided in a space communicating with the gap between an end surface of the cover on one side in the direction of the axial line and an opposing surface facing the end surface in the direction of the axial line to protrude from the opposing surface of the casing toward the end surface and formed of a material having higher machinability than the cover, wherein the end surface of the cover includes a cover curved surface that is curved from one side in the direction of the axial line toward the other side along a direction from a radially outer side of the axial line toward a radially inner side thereof, the cover further includes a cover parallel surface that continues from an end edge of the cover curved surface on a radially inner side toward the other side in the direction of the axial line and extends in parallel with the axial line, a surface of the lid member on the other side in the direction of the axial line is a curved opposing surface that is curved from one side in the direction of the axial line toward the other side along a direction from a radially outer side of the axial line toward a radially inner side thereof, a surface of the lid member on the radially inner side of the axial line is a parallel inner circumferential surface that extends in parallel with the axial line, the curved opposing surface and the parallel inner circumferential surface form a fin portion at the other side in the direction of the axial line, and the fin portion and the cover curved surface of the cover at least partially overlap each other when seen in a radial direction of the axial line.

2. The rotary machine according to claim 1, wherein the parallel inner circumferential surface and the cover parallel surface have the same position in the radial direction of the axial line when seen in the direction of the axial line.

3. The rotary machine according to claim 1, wherein the fin portion and the end surface of the cover contact each other.

4. A method for manufacturing a rotary machine which includes an impeller including a discoid disk configured to rotate about an axis line, blades disposed circumferentially at intervals on a surface of the disk facing one side in a direction of the axial line and configured to form a flow path therebetween which extends radially outward from one side in the direction of the axial line, and a cover configured to cover the blades from a radially outer side; a casing configured to cover the impeller from the radially outer side and to form a gap between the casing and an outer surface of the cover and divided into a plurality of parts in the direction of the axial line; and a lid member provided in a space communicating with the gap between an end surface of the cover on one side in the direction of the axial line and an opposing surface facing the end surface of the casing in the direction of the axial line to protrude from the opposing surface toward the end surface and formed of a material having higher machinability than the cover, the method comprising:

preparing the impeller, installing the lid member on the opposing surface, installing the divided casing from both sides in the direction of the axial line in a state in which the lid member and the end surface of the cover are in contact with each other, and rotationally driving the impeller about the axial line and cutting the lid member by contact between the lid member and the end surface of the cover.

* * * * *